US010780592B2

(12) United States Patent
Liang et al.

(10) Patent No.: US 10,780,592 B2
(45) Date of Patent: Sep. 22, 2020

(54) KNIFE

(71) Applicant: BINOVO MANUFACTURING CO., LTD, Guangdong (CN)

(72) Inventors: Bing Liang, Guangdong (CN); Houkun Liang, Guangdong (CN)

(73) Assignee: BINOVO MANUFACTURING CO., LTD, Guangdong (CN)

( * ) Notice: Subject to any disclaimer, the term of this patent is extended or adjusted under 35 U.S.C. 154(b) by 0 days.

(21) Appl. No.: 16/262,963

(22) Filed: Jan. 31, 2019

(65) Prior Publication Data

US 2019/0240849 A1 Aug. 8, 2019

(30) Foreign Application Priority Data

Feb. 6, 2018 (CN) ..... 2018 2 0211102 U

(51) Int. Cl.
*B26B 1/04* (2006.01)
*B26B 1/10* (2006.01)
*B26B 5/00* (2006.01)

(52) U.S. Cl.
CPC ..... *B26B 1/048* (2013.01); *B26B 1/044* (2013.01); *B26B 1/10* (2013.01); *B26B 5/00* (2013.01)

(58) Field of Classification Search
CPC .... B26B 5/00; B26B 1/06; B26B 1/10; B26B 5/006; B26B 5/007; B26B 5/008; B26B 5/005; B26B 5/004; B26B 5/003; B26B 5/002; B26B 5/001; B26B 1/02; B26B 1/042; B26B 1/04; B26B 1/044; B26B 1/046; B26B 1/048
See application file for complete search history.

(56) References Cited

U.S. PATENT DOCUMENTS

| | | | | |
|---|---|---|---|---|
| 9,289,903 | B1 * | 3/2016 | Douzanis | B26B 1/02 |
| 2008/0222896 | A1 * | 9/2008 | Marfione | B26B 1/048 30/157 |
| 2012/0000077 | A1 * | 1/2012 | Caswell | A45F 5/02 30/155 |
| 2019/0134831 | A1 * | 5/2019 | Chiu | B26B 5/006 |
| 2019/0366567 | A1 * | 12/2019 | Mitchell | B26B 1/02 |

FOREIGN PATENT DOCUMENTS

| | | | | |
|---|---|---|---|---|
| DE | 10246079 | A1 * | 4/2003 | B26B 1/048 |

* cited by examiner

*Primary Examiner* — Kenneth E Peterson
*Assistant Examiner* — Sina A. Shayan
(74) *Attorney, Agent, or Firm* — Gang Yu

(57) ABSTRACT

Provided is a knife, including: blade; a first hilt assembly; a second hilt assembly, the blade being detachably disposed between the first hilt assembly and the second hilt assembly; a connecting portion, disposed on the first hilt assembly; and a handle clip, disposed on the second hilt assembly, wherein a position of the connecting portion is adjustable, such that the connecting portion has a locking position connected to the handle clip and an opening position separated from the handle clip. The knife of the present disclosure solves the problem in the related technology that it is more complicated to disassemble blade of a knife.

9 Claims, 6 Drawing Sheets

KNIFE

TECHNICAL FIELD

The present disclosure relates to the field of tools, and more particularly to a knife.

BACKGROUND

In the existing knife with a detachable blade, the blade can be taken out only after a locking structure is detached by other tools such as a screwdriver, and furthermore, the knife is loosened in a threaded manner. These mechanisms cause inconvenience in use, and the blade cannot be quickly assembled and disassembled.

SUMMARY

Some embodiments of the present disclosure provide a knife, so as to solve the problem in the related technology that it is more complicated to disassemble blade of a knife.

To achieve the foregoing objective, an embodiment of the present disclosure provides a knife, including: blade; a first hilt assembly; a second hilt assembly, the blade being detachably disposed between the first hilt assembly and the second hilt assembly; a connecting portion, disposed on the first hilt assembly; and a handle clip, disposed on the second hilt assembly, wherein a position of the connecting portion is adjustable, such that the connecting portion has a locking position connected to the handle clip and an opening position separated from the handle clip.

In an exemplary embodiment, the handle clip is disposed on the second hilt assembly in a position adjustable manner, the handle clip has a first position and a second position, when the handle clip is at the first position, the connecting portion is fixed to the locking position, and when the handle clip is at the second position, the connecting portion moves from the locking position to the opening position.

In an exemplary embodiment, the handle clip is provided with a first sliding groove, the connecting portion penetrates into the first sliding groove, and when the handle clip moves between the first position and the second position, the connecting portion slides relative to the first sliding groove.

In an exemplary embodiment, the first sliding groove includes: a first sliding groove segment, the first sliding groove segment extending along a movement direction of the handle clip; and a second sliding groove segment, the second sliding groove segment communicating with the first sliding groove segment, wherein when the handle clip is at the first position, a part of the connecting portion is locked in the first sliding groove segment, and when the handle clip is at the second position, the connecting portion penetrates through the second sliding groove segment and is separated from the handle clip.

In an exemplary embodiment, the connecting portion is a connecting rod, at least part of the first sliding groove segment is a rectangular groove, the second sliding groove segment is an arc-shaped groove, and a diameter of a partial rod segment, close to the second hilt assembly, of the connecting portion is greater than an opening width D1 of the first sliding groove segment, such that the connecting portion is locked on the handle clip; and an opening width D2 of the second sliding groove segment is greater than the maximum diameter of the connecting portion, such that the connecting portion is separated from the handle clip.

In an exemplary embodiment, the knife further includes: an elastic piece, a first end of the elastic piece is abutted against the first hilt assembly, a second end of the elastic piece is abutted against the connecting portion, and the elastic piece is able to stretch out and draw back, wherein when the handle clip is at the first position, the connecting portion compresses the elastic piece, and when the handle clip is at the second position, the elastic piece stretches to push the connecting portion to be separated from the handle clip.

In an exemplary embodiment, the knife further includes: a stopping portion, the stopping portion being disposed on the second hilt assembly in a position adjustable manner, the stopping portion having an unlocking position and a fixed position, wherein when the stopping portion is at the unlocking position, the handle clip is movable to the second position from the first position, and when the stopping portion is at the fixed position and the handle clip moves to a predetermined position, the stopping portion is in limited contact with the handle clip, the predetermined position being located between the first position and the second position, and the handle clip being movable between the first position and the predetermined position.

In an exemplary embodiment, the second hilt assembly is provided with a second sliding groove, and the stopping portion includes: a stopping sheet, the stopping sheet being disposed on one side, close to the connecting portion, of the second hilt assembly, and the stopping sheet being configured to be in limited contact with the handle clip; and an operating rod, the operating rod penetrating through the second sliding groove and being connected to the stopping sheet, and the operating rod being located outside the second hilt assembly, wherein the operating rod is movably disposed in the second sliding groove, such that the stopping sheet has the unlocking position and the fixed position.

In an exemplary embodiment, the blade is rotatably disposed at a first end of the first hilt assembly and the second hilt assembly, the connecting portion is disposed at a second end of the first hilt assembly, and the handle clip is disposed at a second end of the second hilt assembly.

In an exemplary embodiment, the knife further includes: a connecting shaft, a first end of the connecting shaft being detachably connected to the second hilt assembly, and a second end of the connecting shaft penetrating through the blade and being connected to the first hilt assembly, wherein the second end of the connecting shaft is provided with a locking portion, and the connecting shaft is rotatably disposed relative to the first hilt assembly, such that the locking portion has a third position clamped with the first hilt assembly and a fourth position separated from the first hilt assembly.

In an exemplary embodiment, the blade is provided with a first clamping groove, the first hilt assembly is provided with a second clamping groove, the locking portion penetrates through the first clamping groove and the second clamping groove in sequence, when the locking portion is at the third position, the locking portion is clamped with the second clamping groove, and when the locking portion is at the fourth position, the locking portion may penetrate through the first clamping groove and the second clamping groove.

Blade of the knife of the present disclosure can be quickly disassembled from a first hilt assembly and a second hilt assembly through a connecting portion and a handle clip. The blade is detachably disposed between the first hilt assembly and the second hilt assembly, the connecting portion is disposed on the first hilt assembly, and the handle clip is disposed on the second hilt assembly. During mounting, the position of the connecting portion is adjusted, so that the connecting portion is connected to the handle clip, thereby stably clamping the blade between the first hilt assembly and the second hilt assembly. During disassembling, the position of the connecting portion is adjusted, so that the connecting portion is separated from the handle clip, thereby separating the blade from the first hilt assembly and the second hilt assembly. Blade of the knife of the present disclosure can be quickly disassembled from a first hilt assembly and a second hilt assembly through a connecting portion and a handle clip, thereby solving the problem in the related technology that it is more complicated to disassemble blade of a knife.

BRIEF DESCRIPTION OF THE DRAWINGS

The accompanying drawings, which constitute a part of this application, are used to provide a further understanding of the present disclosure, and the exemplary embodiments of the present disclosure and the description thereof are used to explain the present disclosure, but do not constitute improper limitations to the present disclosure. In the drawings.

Figure 1:
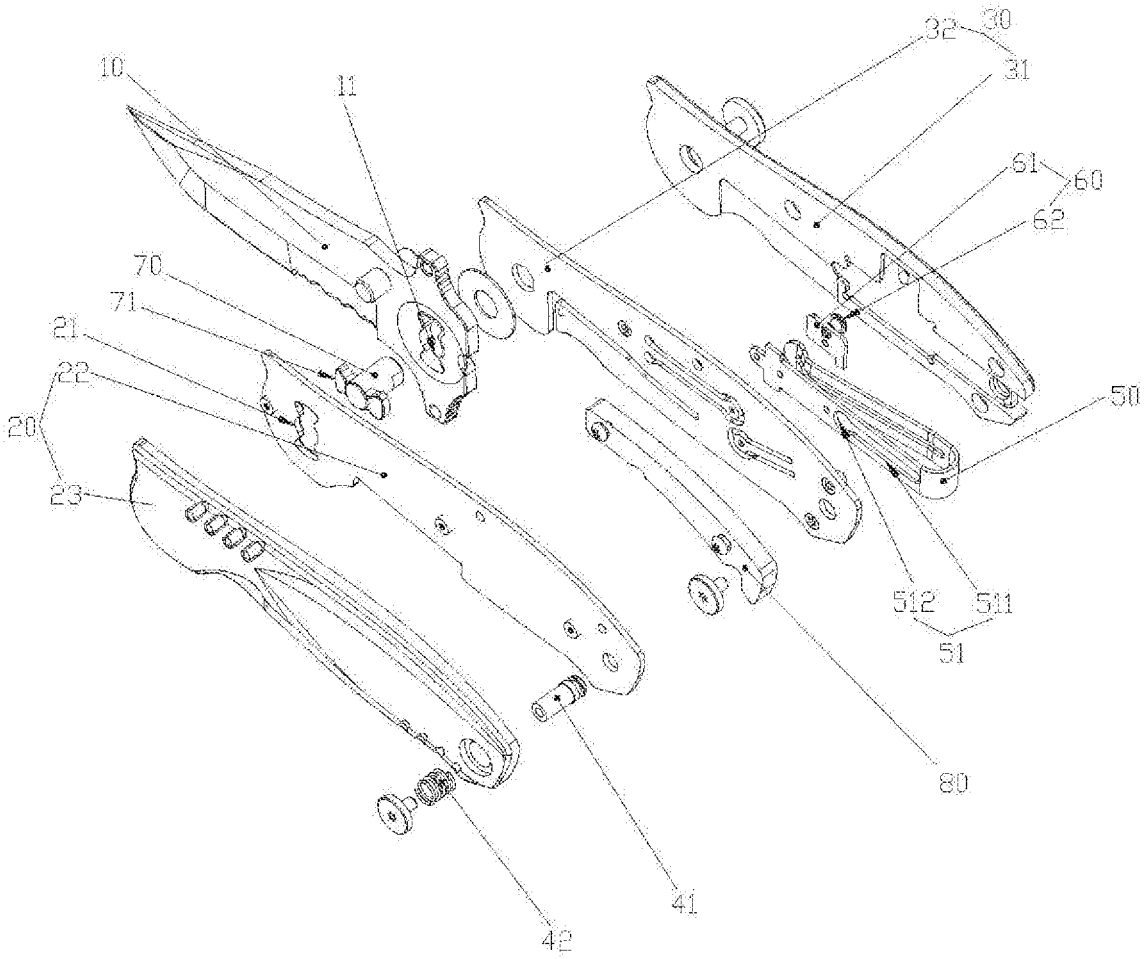
FIG. 1 illustrates a schematic diagram of a breakdown structure of a knife according to the present disclosure from a first perspective.

The drawings include the following reference signs:

10: blade; 11: first clamping groove; 20: first hilt assembly; 21: second clamping groove; 22: first mask; 23: first handle; 30: second hilt assembly; 31: second handle; 32: second mask; 33: second sliding groove; 41: connecting portion; 42: elastic piece; 50: handle clip; 51: first sliding groove; 511: first sliding groove segment; 512: second sliding groove segment; 60: stopping portion; 61: stopping sheet; 62: operating rod; 70: connecting shaft; 71: locking portion; 80: trailing spring.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

It is to be noted that the following detailed description is illustrative and is intended to provide a further description of the present application. All technical and scientific terms used herein have the same meaning as commonly understood by those of ordinary skill in the art to which the present application belongs, unless otherwise indicated.

It is to be noted that terms used herein only aim to describe specific implementation manners, and are not intended to limit exemplar implementations of this application. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

The present disclosure provides a knife. Referring to FIG. 1 to FIG. 6, the knife includes: blade 10; a first hilt assembly 20; a second hilt assembly 30, the blade 10 being detachably disposed between the first hilt assembly 20 and the second hilt assembly 30; a connecting portion 41, the connecting portion 41 being disposed on the first hilt assembly 20; and a handle clip 50, the handle clip 50 being disposed on the second hilt assembly 30, wherein a position of the connecting portion 41 is adjustable, such that the connecting portion 41 has a locking position connected to the handle clip 50 and an opening position separated from the handle clip 50.

The blade 10 of the knife of the present disclosure can be quickly disassembled from the first hilt assembly 20 and the second hilt assembly 30 through the connecting portion 41 and the handle clip 50. The blade 10 is detachably disposed between the first hilt assembly 20 and the second hilt assembly 30, the connecting portion 41 is disposed on the first hilt assembly 20, and the handle clip 50 is disposed on the second hilt assembly 30. During mounting, the position of the connecting portion 41 is adjusted, so that the connecting portion 41 is connected to the handle clip 50, thereby stably clamping the blade 10 between the first hilt assembly 20 and the second hilt assembly 30. During disassembling, the position of the connecting portion 41 is adjusted, so that the connecting portion 41 is separated from the handle clip 50, thereby separating the blade 10 from the first hilt assembly 20 and the second hilt assembly 30. The blade 10 of the knife of the present disclosure can be quickly disassembled from the first hilt assembly 20 and the second hilt assembly 30 through the connecting portion 41 and the handle clip 50, thereby solving the problem in the related technology that it is more complicated to disassemble blade of a knife.

In order to make the connecting portion 41 movable between the locking position and the opening position, the handle clip 50 is disposed on the second hilt assembly 30 in a position adjustable manner, the handle clip 50 has a first position and a second position, when the handle clip 50 is at the first position, the connecting portion 41 is fixed to the locking position, and when the handle clip 50 is at the second position, the connecting portion 41 moves from the locking position to the opening position.

In the present embodiment, the handle clip 50 is disposed on the second hilt assembly 30 in a position adjustable manner, so that the handle clip 50 has the first position and the second position.

In the present embodiment, when the handle clip 50 is at the first position, the connecting portion 41 is fixed at the locking position, and at this time, the connecting portion 41 is connected to the handle clip 50. When the handle clip 50 is at the second position, the connecting portion 41 moves from the locking position to the opening position, and at this time, the connecting portion 41 is separated from the handle clip 50.

In order to make the connecting portion 41 not affect a movement of the handle clip 50 between the first position and the second position, as shown in FIG. 1, the handle clip 50 is provided with a first sliding groove 51, the connecting portion 41 penetrates into the first sliding groove 51, and when the handle clip 50 moves between the first position and the second position, the connecting portion 41 slides relative to the first sliding groove 51.

In the present embodiment, the handle clip 50 is provided with a first sliding groove 51, wherein the connecting portion 41 penetrates into the first sliding groove 51, and when the handle clip 50 moves between the first position and the second position, the connecting portion 41 slides relative to the first sliding groove 51.

For the specific structure of the first sliding groove 51, as shown in FIG. 1, the first sliding groove 51 includes: a first sliding groove segment 511, the first sliding groove segment 511 extending along a movement direction of the handle clip 50; and a second sliding groove segment 512, the second sliding groove segment 512 communicating with the first sliding groove segment 511, wherein when the handle clip 50 is at the first position, a part of the connecting portion 41 is locked in the first sliding groove segment 511, and when the handle clip 50 is at the second position, the connecting portion 41 penetrates through the second sliding groove segment 512 and is separated from the handle clip 50.

In the present embodiment, the first sliding groove 51 is composed of the first sliding groove segment 511 and the second sliding groove segment 512, wherein the first sliding groove segment 511 extends along a movement direction of the handle clip 50, and the second sliding groove segment 512 communicates with the first sliding groove segment 511.

In the present embodiment, when the handle clip 50 is at the first position, a part of the connecting portion 41 is locked in the first sliding groove segment 511, and at this time, the connecting portion 41 is connected to the handle clip 50. When the handle clip 50 is at the second position, the connecting portion 41 penetrates through the second sliding groove segment 512 and is separated from the handle clip 50.

Preferably, the connecting portion 41 is a connecting rod, at least part of the first sliding groove segment 511 is a rectangular groove, the second sliding groove segment 512 is an arc-shaped groove, and a diameter of a partial rod segment, close to the second hilt assembly 30, of the connecting portion 41 is greater than an opening width D1 of the first sliding groove segment 511, such that the connecting portion 41 is locked on the handle clip 50; and an opening width D2 of the second sliding groove segment 512 is greater than the maximum diameter of the connecting portion 41, such that the connecting portion 41 is separated from the handle clip 50.

In the present embodiment, the first sliding groove 51 is a through groove.

Figure 2:
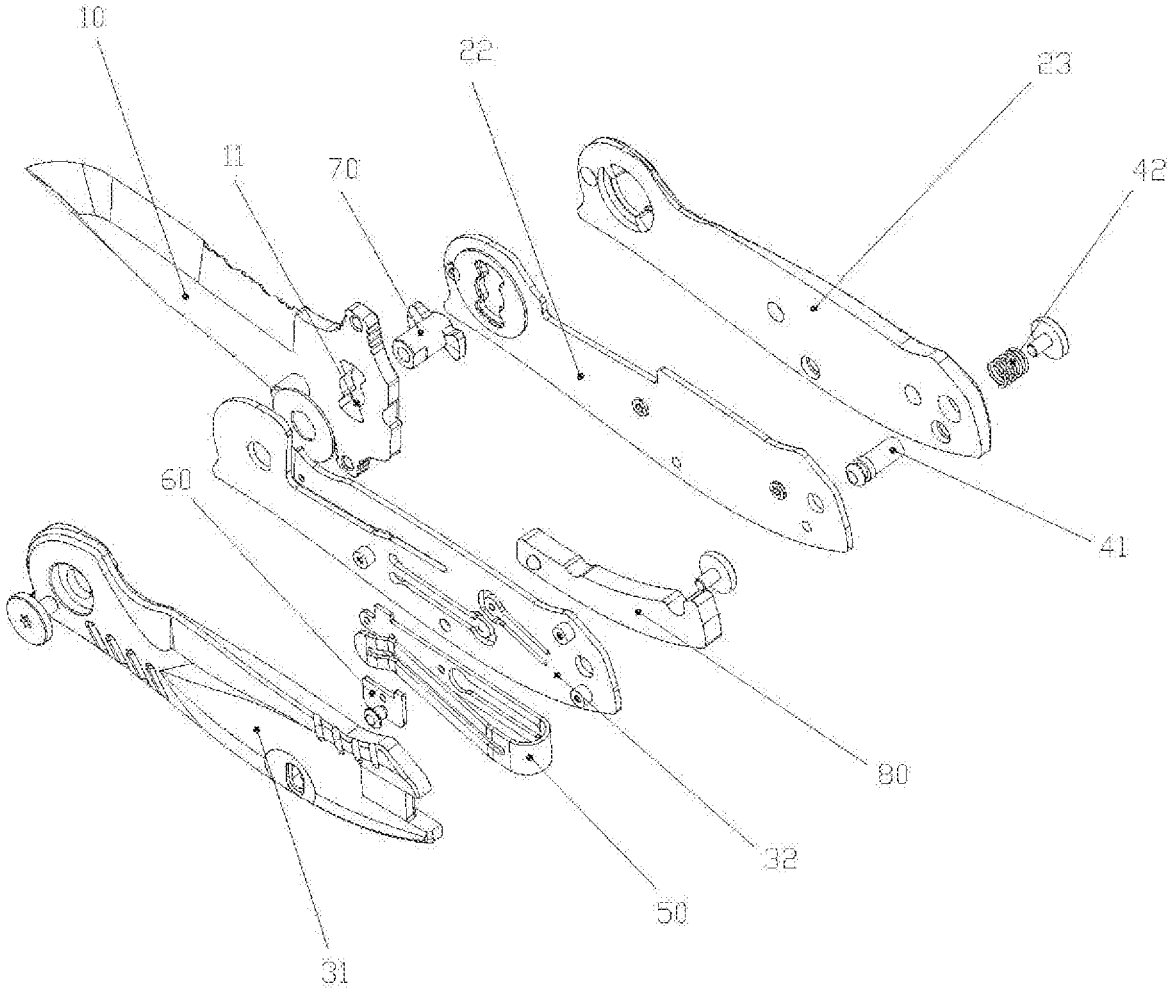
FIG. 2 illustrates a schematic diagram of a breakdown structure of a knife according to the present disclosure from a second perspective.

In order to make the connecting portion 41 automatically move from the locking position to the opening position, as shown in FIG. 1 and FIG. 2, the knife further includes: an elastic piece 42, a first end of the elastic piece 42 is abutted against the first hilt assembly 20, a second end of the elastic piece 42 is abutted against the connecting portion 41, and the elastic piece 42 is able to stretch out and draw back, wherein when the handle clip 50 is at the first position, the connecting portion 41 compresses the elastic piece 42, and when the handle clip 50 is at the second position, the elastic piece 42 stretches to push the connecting portion 41 to be separated from the handle clip 50.

In the present embodiment, the elastic piece 42 is disposed on the knife, wherein the first end of the elastic piece 42 urges against the first hilt assembly 20, and the second end of the elastic piece 42 urges against the connecting portion 41.

Optionally, a first end of the elastic piece 42 urges against the second hilt assembly 30, and a second end of the elastic piece 42 urges against the connecting portion 41.

In the present embodiment, the elastic piece 42 is able to stretch out and draw back, so that when the handle clip 50 is at the first position, the connecting portion 41 compresses the elastic piece 42. At this time, since the connecting portion 41 is locked on the handle clip 50, an elastic force of the elastic piece 42 cannot pop up the connecting portion. When the handle clip 50 is at the second position, the connecting portion 42 stretches to push the connecting portion 41 to be separated from the handle clip 50.

In the present embodiment, the elastic piece 42 is a spring.

Figure 3:
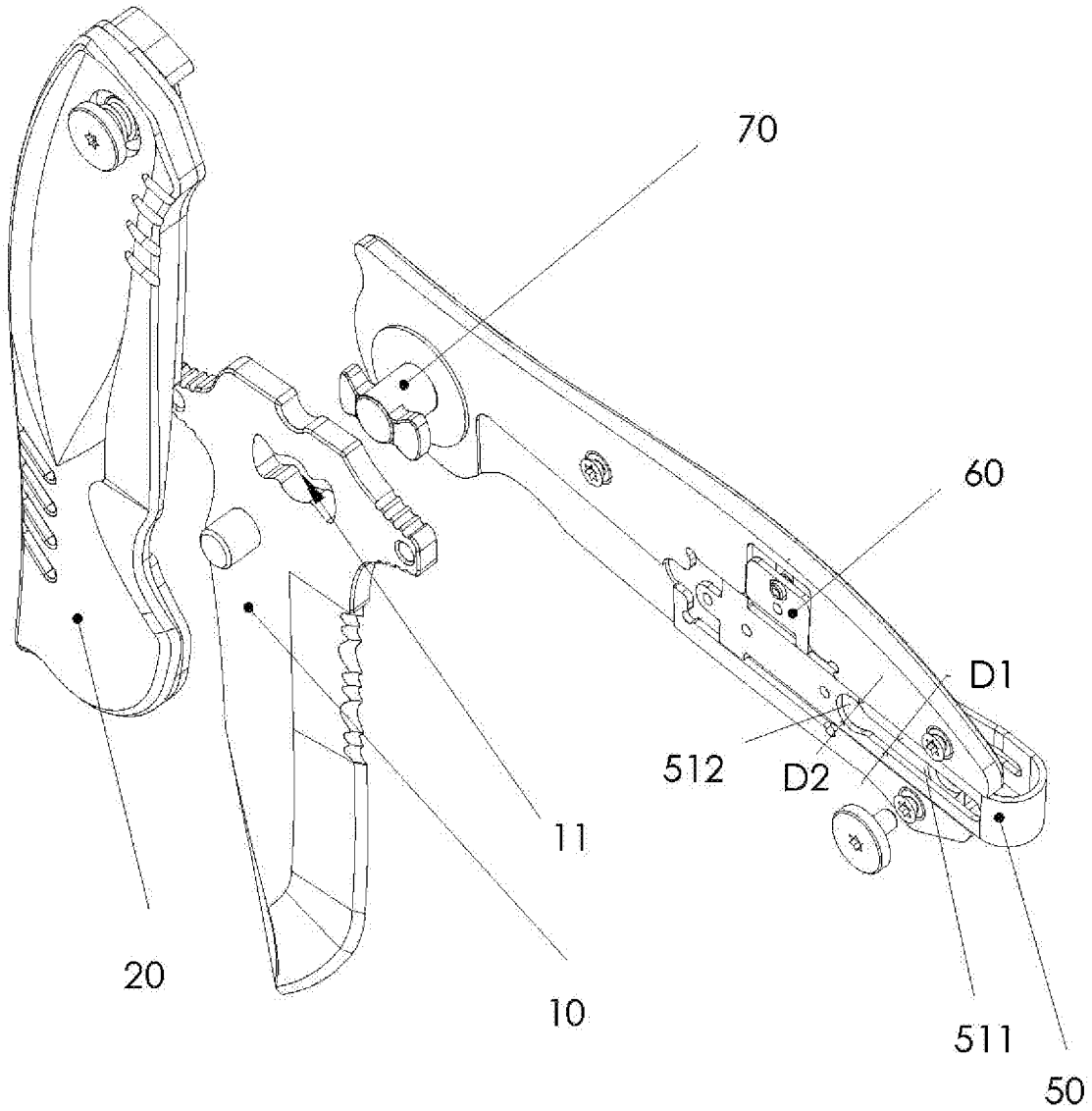
FIG. 3 illustrates an exploded schematic diagram of a partial structure of a knife according to the present disclosure from a first perspective.
Figure 4:
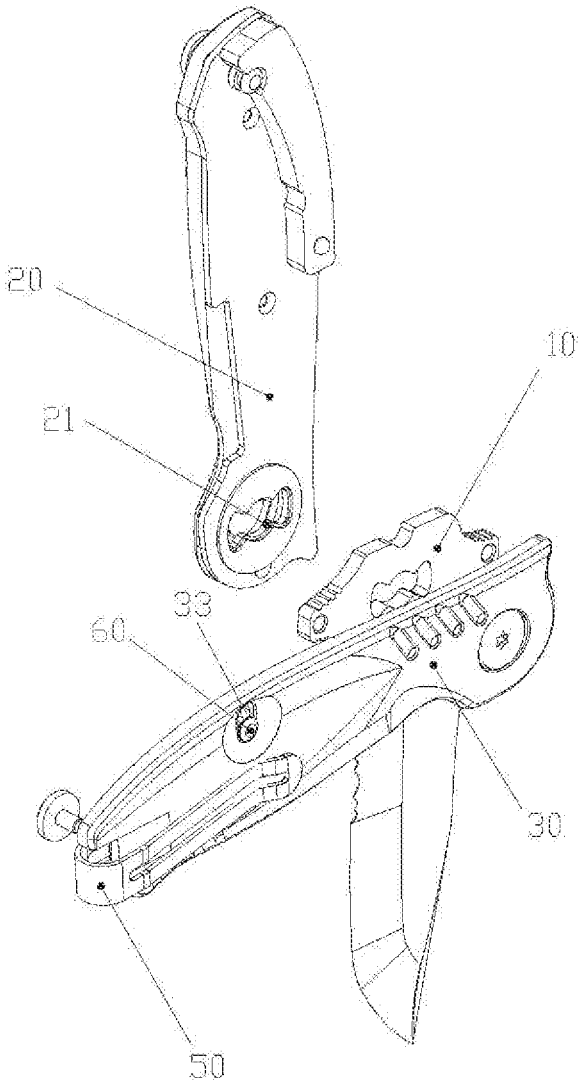
FIG. 4 illustrates an exploded schematic diagram of a partial structure of a knife according to the present disclosure from a second perspective.

In order to ensure that the handle clip 50 moves between the first position and the second position, as shown in FIG. 3 and FIG. 4, the knife further includes: a stopping portion 60, the stopping portion 60 being disposed on the second hilt assembly 30 in a position adjustable manner, the stopping portion 60 having an unlocking position and a fixed position, wherein when the stopping portion 60 is at the unlocking position, the handle clip 50 is movable to the second position from the first position, and when the stopping portion 60 is at the fixed position and the handle clip 50 moves to a predetermined position, the stopping portion 60 is in limited contact with the handle clip 50, the predetermined position being located between the first position and the second position, and the handle clip 50 being movable between the first position and the predetermined position.

In the present embodiment, the stopping portion 60 is disposed on the knife, wherein the stopping portion 60 is disposed on the second hilt assembly 30 in a position adjustable manner, and the stopping portion 60 has the unlocking position and the fixed position.

When the stopping portion 60 is at the unlocking position, the handle clip 50 is movable to the second position from the first position. When the stopping portion 60 is at the fixed position and the handle clip 50 moves to a predetermined position, the stopping portion 60 is in limited contact with the handle clip 50, wherein the predetermined position is located between the first position and the second position, and the handle clip 50 is movable between the first position and the predetermined position.

In the present embodiment, the handle clip 50 has three basic positions, that is, the first position, the predetermined position and the second position, and when the handle clip 50 is at the first position, the handle clip 50 is in a retracted state. When the handle clip 50 is at the predetermined position and the second position, the handle clip 50 is in a stretching state.

In order to make the stopping portion 60 have the unlocking position and the fixed position, as shown in FIG. 4, the second hilt assembly 30 is provided with a second sliding groove 33, and the stopping portion 60 includes: a stopping sheet 61, the stopping sheet 61 being disposed on one side, close to the connecting portion 41, of the second hilt assembly 30, and the stopping sheet 61 being configured to be in limited contact with the handle clip 50; and an operating rod 62, the operating rod 62 penetrating through the second sliding groove 33 and being connected to the stopping sheet 61, and at least part of the operating rod 62 being located outside the second hilt assembly 30, wherein the operating rod 62 is movably disposed in the second sliding groove 33, such that the stopping sheet 61 has the unlocking position and the fixed position.

In the present embodiment, the second hilt assembly 30 includes a second mask 32 and a second handle 31, wherein the stopping portion 60 is disposed on the second handle 31, and the second mask 32 is provided with a contact point in contact with the operating rod 62, so as to determine that the stopping portion 60 is located at the unlocking position and the fixed position.

Preferably, the blade 10 is rotatably disposed at a first end of the first hilt assembly 20 and the second hilt assembly 30, the connecting portion 41 is disposed at a second end of the first hilt assembly 20, and the handle clip 50 is disposed at a second end of the second hilt assembly 30.

Figure 5:
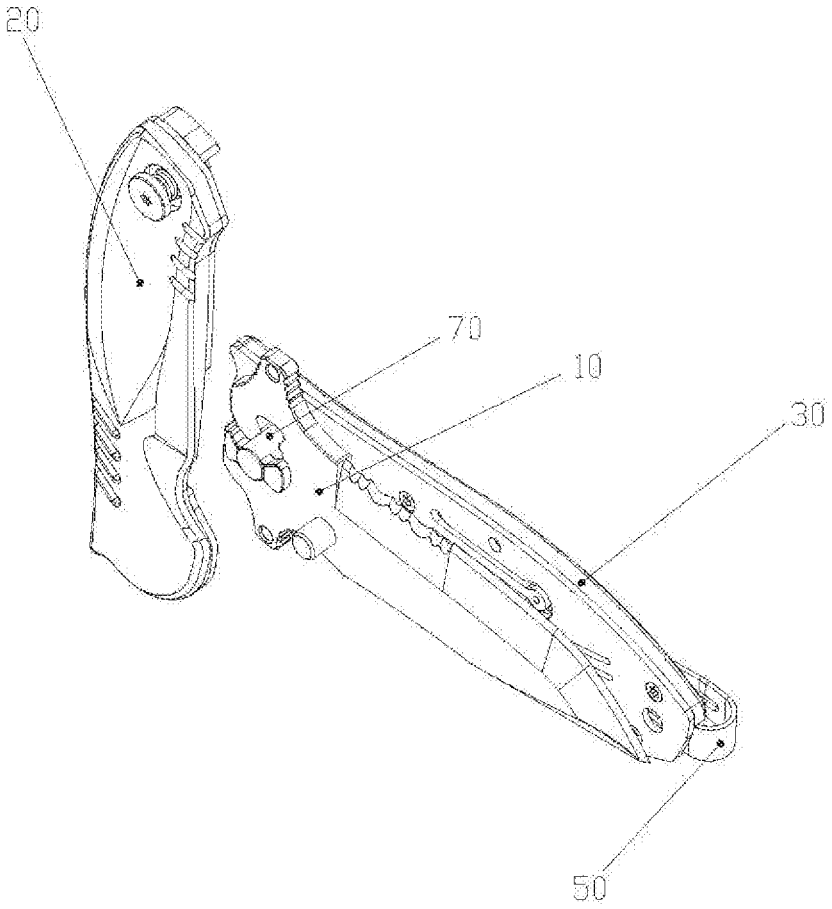
FIG. 5 illustrates a schematic diagram of a breakdown structure of a first hilt assembly and a second hilt assembly of a knife according to the present disclosure.

Preferably, as shown in FIG. 5, the knife further includes: a connecting shaft 70, a first end of the connecting shaft 70 being detachably connected to the second hilt assembly 30, and a second end of the connecting shaft 70 penetrating through the blade 10 and being connected to the first hilt assembly 20, wherein the second end of the connecting shaft 70 is provided with a locking portion 71, and the connecting shaft 70 is rotatably disposed relative to the first hilt assembly 20, such that the locking portion 71 has a third position clamped with the first hilt assembly 20 and a fourth position separated from the first hilt assembly 20.

Preferably, the blade 10 is provided with a first clamping groove 11, the first hilt assembly 20 is provided with a second clamping groove 21, the locking portion 71 penetrates through the first clamping groove 11 and the second clamping groove 21 in sequence, when the locking portion 71 is at the third position, the locking portion 71 is clamped with the second clamping groove 21, and when the locking portion is at the fourth position, the locking portion 71 may penetrate through the first clamping groove 11 and the second clamping groove 21.

In the present embodiment, the first hilt assembly 20 includes the first mask 22 and the first handle 23, the second clamping groove 21 being provided on the first mask 22.

In the present embodiment, the handle clip 50 includes a first clamping arm, a second clamping arm and a connecting portion, the connecting portion is disposed between the first clamping arm and the second clamping arm, and at least part of the second hilt assembly 30 is clamped between the first clamping arm and the second clamping arm.

In the present embodiment, the knife further includes a tailing spring 80, the tailing spring 80 being disposed on the first hilt assembly 20.

The first clamping groove 11 and the second clamping groove 21 in the knife of the present disclosure are butterfly-shaped through holes, and the locking portion 71 is a butterfly-shaped lock. When the locking portion 71 fits the first clamping groove 11, the blade 10 rotates by taking the connecting shaft 70 as the axis, and reaches a locked state (the third position) through the butterfly-shaped lock.

The first hilt assembly 20 rotates clockwise for 90 degrees by taking the connecting shaft 70 as the axis, and forms a first locking state through the butterfly-shaped lock.

As shown in FIG. 1 and FIG. 3, the tail of the first hilt assembly 20 is provided with a lock pin assembly formed by connecting a spring and a lock pin (connecting portion 41) through a screw. A locking head is disposed at one end of the lock pin, and the lock pin pushes leftward against the outside of a handle through the spring under an unlocking state, so as to prevent interference during the rotation of the first hilt assembly 20.

Figure 6:
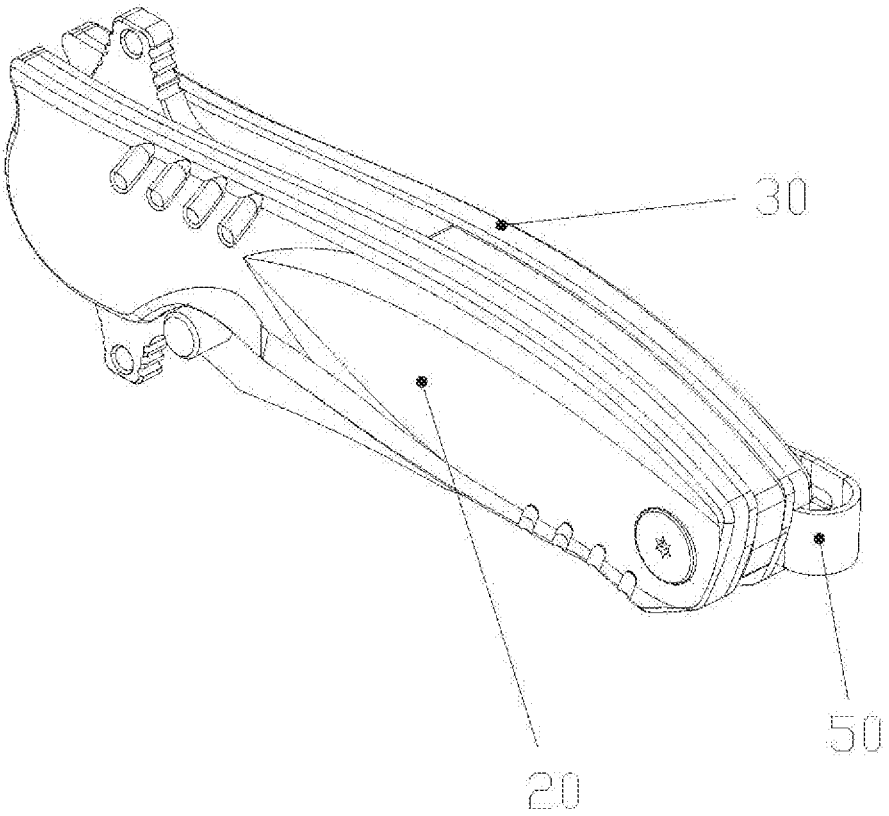
FIG. 6 illustrates a schematic diagram of an assembled structure of a knife according to the present disclosure.

As shown in FIG. 1, FIG. 3 and FIG. 6, a sliding sheet part of a clip (handle clip 50) between the second mask 32 and the second handle 31 is provided with a sliding groove (first sliding groove 51), a groove body part of the sliding groove is set so that the width is smaller than a diameter of the locking head on the lock pin, one end of the sliding groove is provided with a lock pin hole, and the lock pin hole is set to be larger than the locking head on the lock pin in diameter. When the clip is pushed manually to make the lock pin hole and the lock pin concentric, the lock pin is pressed manually to make the locking head at one end of the lock pin completely penetrate through the sliding sheet part of the clip, the clip is pushed manually to move toward a knife bit, and the clip reaches a locking state, so that the blade 10, the first hilt assembly 20 and the second hilt assembly 30 form a second locking state.

As shown in FIG. 1, FIG. 3 and FIG. 6, a sliding sheet (stopping portion 60) between the second mask 32 and the second handle 31 is provided with a pin head (operating rod 62). When the pin head is pushed manually to make the locking sheet to move toward the clip, the clip is under the second locking state, the clip is limited by the locking sheet, and the locking sheet prevents the lock pin hole on the clip and the lock pin from being concentric when sliding through the clip, so that the clip cannot be unlocked under a free pushing state, so as to form a third locking state.

Under the above state, the overall assembling of a knife is completed so as to achieve the purpose of assembling, disassembling and replacing blade, and the knife can be unlocked and disassembled when three locking states are reverse.

The present disclosure has the advantages that the structure is simple; the knife can be assembled by three locking states completed in sequence; various mechanisms fit each other to facilitate assembly and disassembly; blade can be replaced conveniently; the operation strength is uniform and mild; the structure fit is tight, and the safety is high.

From the above description, it can be seen that the above embodiments of the present disclosure achieve the following technical effects:

The blade 10 of the knife of the present disclosure can be quickly disassembled from the first hilt assembly 20 and the second hilt assembly 30 through the connecting portion 41 and the handle clip 50. The blade 10 is detachably disposed between the first hilt assembly 20 and the second hilt assembly 30, the connecting portion 41 is disposed on the first hilt assembly 20, and the handle clip 50 is disposed on the second hilt assembly 30. During mounting, the position of the connecting portion 41 is adjusted, so that the connecting portion 41 is connected to the handle clip 50, thereby stably clamping the blade 10 between the first hilt assembly 20 and the second hilt assembly 30. During disassembling, the position of the connecting portion 41 is adjusted, so that the connecting portion 41 is separated from the handle clip 50, thereby separating the blade 10 from the first hilt assembly 20 and the second hilt assembly 30. The blade 10 of the knife of the present disclosure can be quickly disassembled from the first hilt assembly 20 and the second hilt assembly 30 through the connecting portion 41 and the handle clip 50, thereby solving the problem in the related technology that it is more complicated to disassemble blade of a knife.

It is to be noted that the specification and claims of the present application and the terms "first", "second" and the like in the drawings are used to distinguish similar objects, and do not need to describe a specific sequence or a precedence order. It will be appreciated that data used in such a way may be exchanged under appropriate conditions, in order that the embodiments of the present application described here can be implemented in a sequence other than sequences graphically shown or described here. In addition, terms 'include' and 'have' and any variations thereof are intended to cover non-exclusive inclusions. For example, it is not limited for processes, methods, systems, products or devices containing a series of steps or units to clearly list those steps or units, and other steps or units which are not clearly listed or are inherent to these processes, methods, products or devices may be included instead.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A knife, comprising:

blade (10);

a first hilt assembly (20);

a second hilt assembly (30), the blade (10) being detachably disposed between the first hilt assembly (20) and the second hilt assembly (30);

a connecting portion (41), the connecting portion (41) being disposed on the first hilt assembly (20); and a handle clip (50), the handle clip (50) being disposed on the second hilt assembly (30), wherein a position of the connecting portion (41) is adjustable, such that the connecting portion (41) has a locking position connected to the handle clip (50) and an opening position separated from the handle clip (50), the handle clip (50) is disposed on the second hilt assembly (30) in a position adjustable manner, the handle clip (50) has a first position and a second position, when the handle clip (50) is at the first position, the connecting portion (41) is fixed to the locking position, and when the handle clip (50) is at the second position, the connecting portion (41) moves from the locking position to the opening position, the handle clip (50) is provided with a first sliding groove (51), the connecting portion (41) penetrates into the first sliding groove (51), and when the handle clip (50) moves between the first Position and the second position, the connecting portion (41) slides relative to the first sliding groove (51).

2. The knife as claimed, in claim 1, further comprising:

a connecting shaft (70), a first end of the connecting shaft (70) being detachably connected to the second hilt assembly (30), and a second end of the connecting shaft (70) penetrating through the blade (10) and being connected to the first hilt assembly (20), wherein the second end of the connecting shaft (70) is provided with a locking portion (71), and the connecting shaft (70) is rotatably disposed relative to the first hilt assembly (20), such that the locking portion (71) has a third position clamped with the first hilt assembly (20) and a fourth position separated from the first hilt assembly (20).

3. The knife as claimed in claim 2, wherein the blade (10) is provided with a first clamping groove (11), the first hilt assembly (20) is provided with a second clamping groove (21), the locking portion (71) penetrates through the first clamping groove (11) and the second clamping groove (21) in sequence, when the locking portion (71) is at the third, position, the locking portion (71) is clamped with the second clamping groove (21), and when the locking portion is at the fourth position, the locking portion (71) penetrates through the first clamping groove (11) and the second clamping groove (21).

4. The knife as claimed in claim 3, wherein the first sliding groove (51) comprises:

a first sliding groove segment (511), the first sliding groove segment (511) extending along a movement direction of the handle clip (50); and a second sliding groove segment (512), the second sliding groove segment (512) communicating with the first sliding groove segment (511), wherein when the handle clip (50) is at the first position, a part of the connecting portion (41) is locked in the first sliding groove segment (511), and when the handle clip (50) is at the second position, the connecting portion (41) penetrates through the second sliding groove segment (512) and is separated from the handle clip (50).

5. The knife as claimed in claim 4, wherein the connecting portion (41) is a connecting rod, at least part of the first sliding groove segment (511) is a rectangular groove, the second sliding groove segment (512) is an arc-shaped groove, and a diameter of a partial rod segment, close to the second hilt assembly (30), of the connecting portion (41) is greater than an opening width D1 of the first sliding groove segment (511), such that the connecting portion (41) is locked on the handle clip (50); and an opening width D2 of the second sliding groove segment (512) is greater than the maximum diameter of the connecting portion (41), such that the connecting portion (41) is separated from the handle clip (50).

6. The knife as claimed in claim 1, further comprising:

an elastic piece (42), a first end of the elastic piece (42) is abutted against the first hilt assembly (20), a second end of the elastic piece (42) is abutted against the connecting portion (41), and the elastic piece (42) is able to stretch out and draw back, wherein when the handle clip (50) is at the first position, the connecting portion (41) compresses the elastic piece (42), and when the handle clip (50) is at the second position, the elastic piece (42) stretches to push the connecting portion (41) to be separated from the handle clip (50).

7. The knife as claimed in claim 1, further comprising:

a stopping portion (60), the stopping portion (60) being disposed on the second hilt assembly (30) in a position adjustable manner, the stopping portion (60) having an unlocking position and a fixed position, wherein when the stopping portion (60) is at the unlocking position, the handle clip (50) is movable to the second position from the first position, and when the stopping portion (60) is at the fixed, position and the handle clip (50) moves to a predetermined position, the stopping portion (60) is in limited contact with the handle clip (50), the predetermined position being located between the first position and the second position, and the handle clip (50) being movable between the first position and the predetermined, position.

8. The knife as claimed in claim 7, wherein the second hilt assembly (30) is provided with a second sliding groove (33), and the stopping portion (60) comprises:

a stopping sheet (61), the stopping sheet (61) being disposed on one side, close to the connecting portion (41), of the second hilt assembly (30), and the stopping sheet (61) being configured to be in limited contact with the handle clip (50); and an operating rod (62), the operating rod (62) penetrating through the second sliding groove (33) and being connected to the stopping sheet (61), and at least part of the operating rod (62) being located outside the second hilt assembly (30), wherein the operating rod (62) is movably disposed in the second sliding groove (33), such that the stopping sheet (61) has the unlocking position and the fixed position.

9. The knife as claimed in claim 1, wherein the blade (10) is rotatably disposed at a first end of the first hilt assembly (20) and a first end of the second hilt assembly (30), the connecting portion (41) is disposed at a second end of the first hilt assembly (20), and the handle clip (50) is disposed at a second end of the second hilt assembly (30).

* * * * *